United States Patent [19]

Miller et al.

[11] 4,241,594

[45] Dec. 30, 1980

[54] SLIDE COVER TYPE CHANGEABLE KEY PLUG PADLOCK

[75] Inventors: Harry C. Miller, Nicholasville; Walter R. Evans, Lancaster, both of Ky.

[73] Assignee: Sargent & Greenleaf, Inc., Nicholasville, Ky.

[21] Appl. No.: 72,041

[22] Filed: Sep. 4, 1979

[51] Int. Cl.[3] ..... E05B 67/22

[52] U.S. Cl. ..... 70/38 A; 70/52; 70/369

[58] Field of Search ..... 70/38 R, 38 A, 38 B, 70/38 C, 39, 50, 51, 52, 367, 368, 369

[56] References Cited

U.S. PATENT DOCUMENTS

| | | | |
|---|---|---|---|
| 2,047,969 | 7/1936 | Keil | 70/52 |
| 2,070,012 | 2/1937 | Jacobi | 70/52 |
| 3,636,738 | 1/1972 | Burekoff | 70/38 A |
| 3,713,309 | 1/1973 | Miller | 70/38 A |

*Primary Examiner*—Robert L. Wolfe
*Attorney, Agent, or Firm*—Mason, Fenwick & Lawrence

[57] ABSTRACT

A changeable plug exposed shackle padlock comprising a padlock casing and a U-shaped shackle having legs with locking notches interfitting in sockets in the upper end of the casing. A key lock plug is removably received in a plug cavity in the casing and an elongated slideway cavity overlying the plug cavity extends through one end of the padlock casing outwardly adjacent the socket for the shorter leg and receives a reciprocative slidable cover member in its upper portion extending in covering relation over the plug cavity with a hole for the shorter shackle leg registering with the socket for that shackle leg when said slide member is in covering relation to the plug cavity. A slidable bolt plate member is guided for longitudinal sliding movement between locking and release positions in the lower portion of the slideway and has locking shoulders engageable in the locking notches of the shackle legs as is driven from the key lock plug.

18 Claims, 16 Drawing Figures

SLIDE COVER TYPE CHANGEABLE KEY PLUG PADLOCK

BACKGROUND AND OBJECTS OF THE INVENTION

The present invention relates in general to changeable plug, key operable padlocks, and more particularly to changeable padlocks of the exposed shackle type, having key lock plugs and a special slide cover for normally closing the cavity housing the key lock plug, permitting replacement of the key lock plug under certain conditions to adapt the padlock for use with a different key.

Heretofore, most key operated padlocks have ordinarily been constructed in such manner that the key lock plug is incorporated in the padlock body during manufacture so that it cannot be replaced without substantial destruction of the lock. However, it has been recognized that it is desirable in many instances, particularly in connection with high security padlocks adapted for warehouse or storage enclosures where constant security supervision is impractical or difficult, to provide for removal of the key lock plug in some manner so that a key plug designed for another key can be substituted to permit operation of the lock by a different key. Two basic types of changeable plug padlocks which have evolved are the bottom loading type, where a bottom plate serves as the removable cover for the plug cavity, and the top loading type, where a removable cover of some type is provided at the top of the padlock body. In the bottom loading type, such locks have been constructed so as to permit removal of the key lock plug either by use of a special change key, or by rotation of one or a pair of retaining screws accessible in the lower part of the socket or sockets for the padlock shackle legs, thus permitting change only when the lock is unlocked, or by retraction of a member accessible through one of the shackle leg sockets only when the associated shackle leg is withdrawn, to release the bottom cover plate. In such cases, the cover plate for the cylinder or plug cavity has been a bottom plate on the padlock body which is retained in position by some type of securing means which is operable only from the interior of the padlock body, but the presence of such a separate plate fixed on the padlock body provides for possibilities of removal of the bottom loading cover by wedges or similar attack tools. However, most previously available padlocks of the above described construction do not have sufficient resistance to attack to meet the requirements of high security lock applications, especially for protection of remote or intermittently supervised security closures.

More recently, high security key operable padlocks of the top loading type have been developed with removable top cover mechanisms for permitting changing of the key lock plug, as disclosed in U.S. Pats. Nos. 3,710,603 and 3,713,309, but it is desired to improve the operation of such padlocks for high security applications and provide locking mechanisms cooperative with the shackle legs to effectively resist strong shackle retracting forces.

An object of the present invention, therefore, is the provision of an improved key operable padlock construction wherein the key lock plug is protected from removal from a cavity therefor in the padlock body by a slidable cover which may be removed from the padlock case in a special manner when the shackle has been withdrawn to release position, thereby permitting substitution of a key lock plug designed for a different key.

Another object of the present invention is the provision of a novel key operable padlock wherein a slide type cover is normally held against movement from a protective position over the cavity housing the key lock plug by one of the legs of the padlock shackle and which is released for removal to a position permitting access to the key lock plug and its housing cavity for substitution of a different key lock plug when the shackle has been withdrawn to unlocking position and the key is positioned in a predetermined way.

In many uses of padlocks, the padlock is in an exposed position in remote, not continuously supervised, locations where a person seeking unauthorized entry into the space secured by the padlock may attempt to attack the padlock with attack tools such as wedges, sledge hammers, carbide tip saws, and other sophisticated devices to destroy the security of the lock. A further object of the present invention, therefore, is the provision of a novel key operable padlock construction for improving the security of padlocks designed to secure remote storage facilities and the like and enhance their resistance against efforts to gain unauthorized entry, wherein the locking mechanism for restraining the shackle within the padlock body and the slide cover for the cavity housing the key lock plug afford strong resistance to attack.

Other objects, advantages and capabilities of the present invention will become apparent from the following detailed description, taken in conjunction with the accompanying drawings illustrating preferred embodiments of the invention.

BRIEF DESCRIPTION OF THE FIGURES

FIGS. 5A–9A are fragmentary sectional views of the undercut notch portions of shackles which may be used with the locking bolt members of FIGS. 5–9, respectively.

DETAILED DESCRIPTION OF PREFERRED EMBODIMENTS

Figure 1:
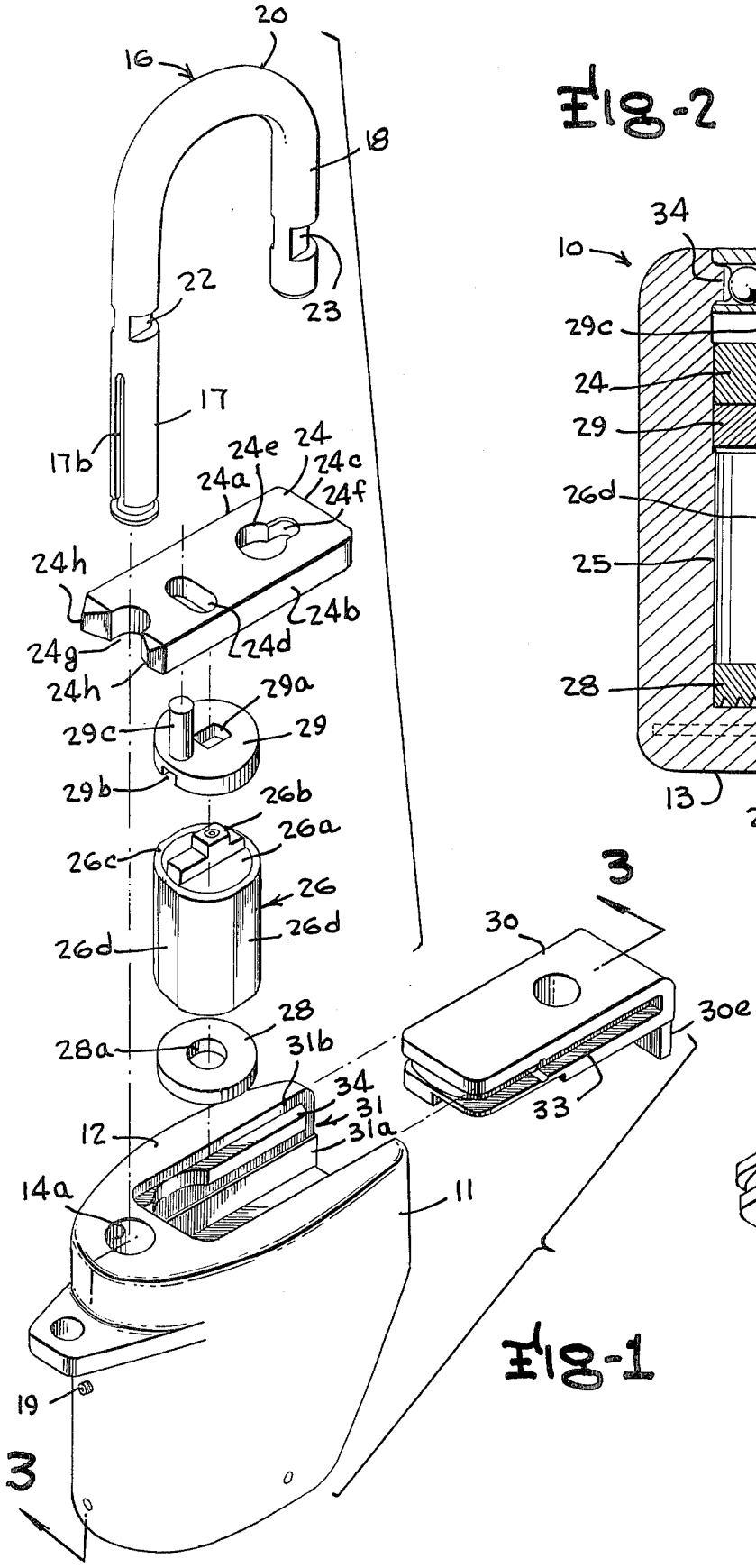
FIG. 1 is an exploded perspective view of an exposed shackle padlock having a slidable cover protecting the key lock plug cavity, embodying the present invention.
Figure 2:
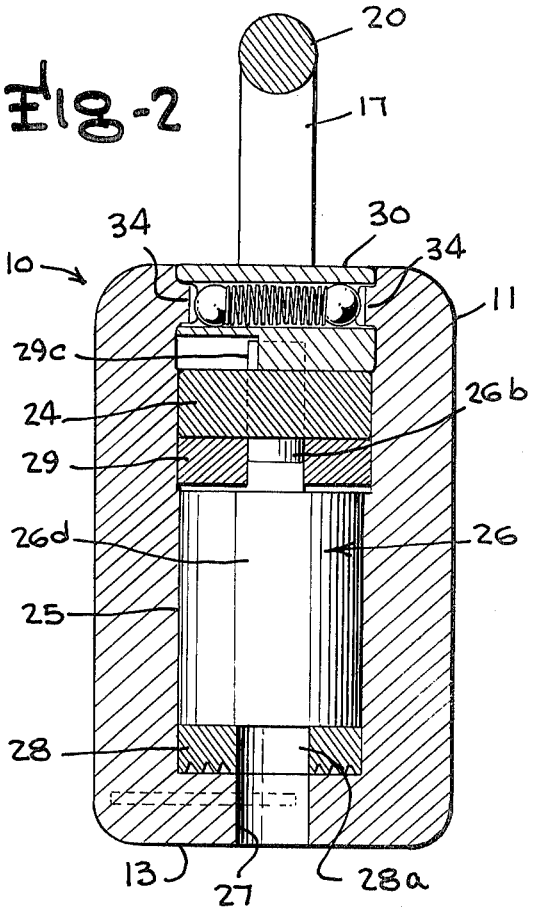
FIG. 2 is a vertical transverse section view thereof taken along the line 2—2 of FIG. 3.
Figure 1A:
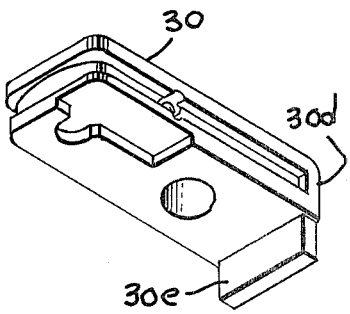
FIG. 1A is a bottom perspective view of the cover member.
Figure 3:
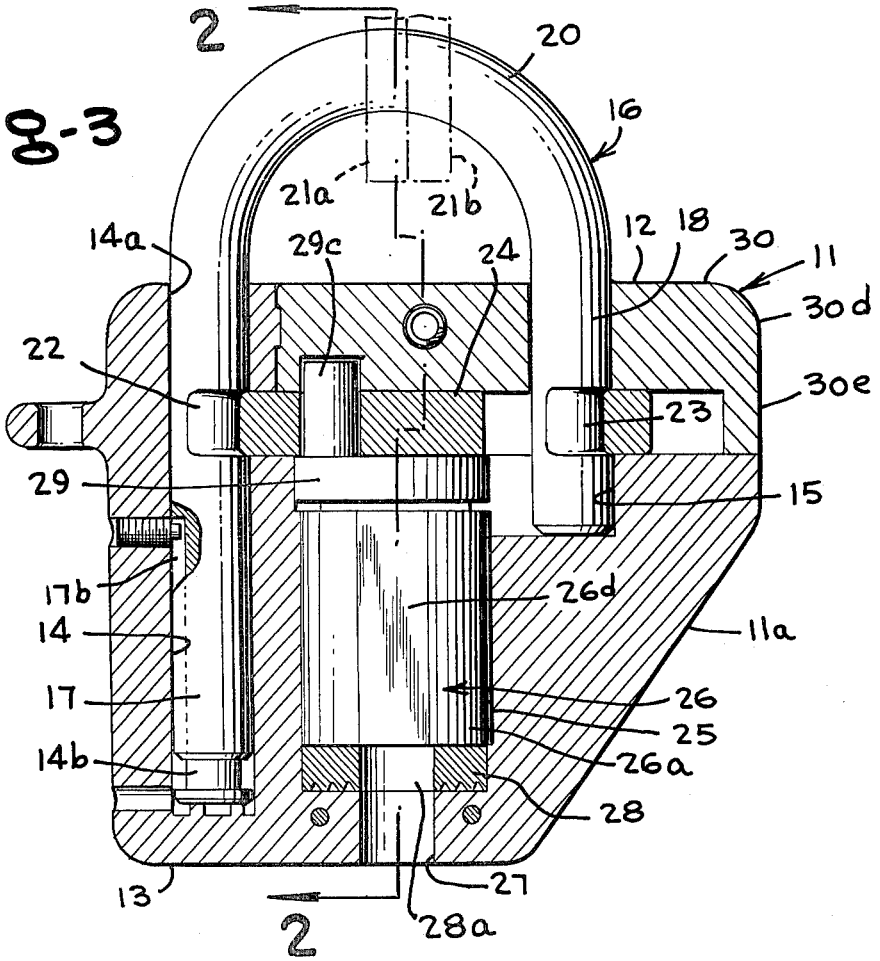
FIG. 3 is a vertical section view thereof taken along the line 3—3 of FIG. 1.
Figure 3A:
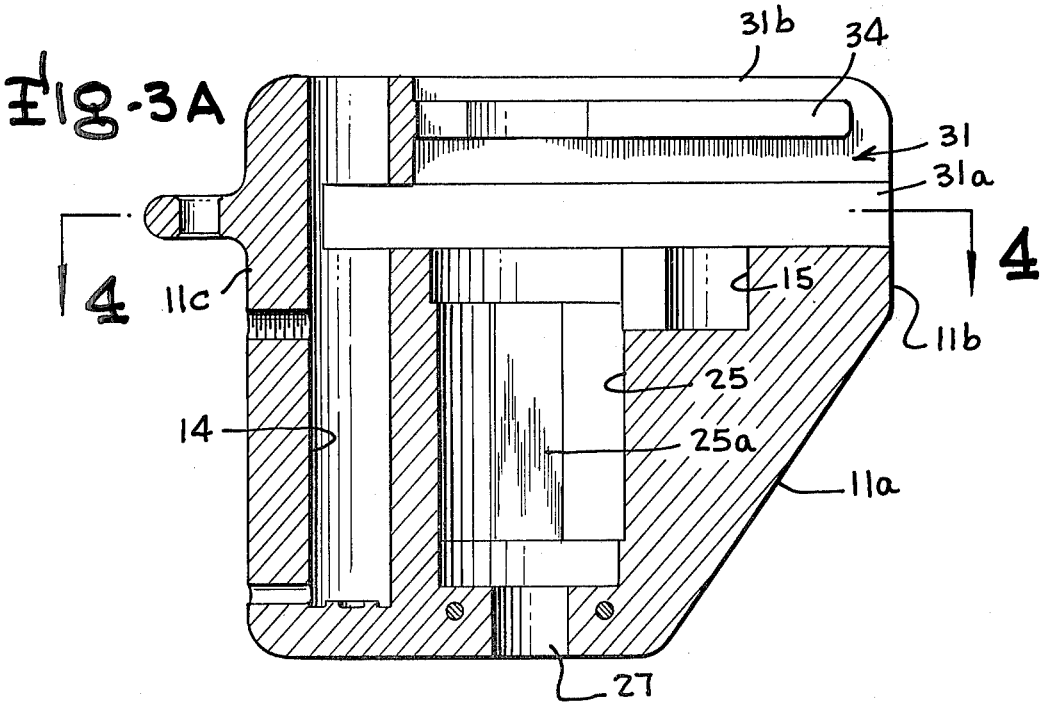
FIGURE 3A is a similar view of the case with the lock parts removed.

Referring to the drawings, wherein like reference characters designate corresponding parts throughout the several figures, there is illustrated in FIGS. 1–5 a form of padlock, indicated generally by the reference character 10, which is of the exposed shackle type. The padlock 10 comprises a padlock body 11 which in the illustrated embodiment is of generally rectangular configuration with rounded corners in end elevation and in horizontal cross section, and in side elevation has a truncated rectangular profile wherein the lower portion includes an inwardly and downwardly inclining end wall portion 11*a*. The padlock body 11 has a top surface 12 and a bottom surface 13, and is preferably a unitary casted body, formed for example of hardened steel, and is provided with a pair of closed bottom sockets or bores 14,15 which are upwardly opening wells for receiving the legs of the shackle 16.

The shackle 16 is preferably in the form of a U-shaped rod of hardened steel having a longer leg 17 and a shorter leg 18. The longer leg 17 passes through the circular entrance opening 14*a* in the top surface 12 into the socket 14 and extends a substantial distance within the padlock body 11 toward the bottom surface 13. The leg 17 is permitted to move axially of the socket between raised and lowered positions and is also permitted rotatable movement relative to the padlock body 11. The shackle 16 may optionally be freely removable from the padlock body 11 when the padlock is in unlocked condition, or if desired may be captured in the socket 14 for the longer leg 17 in the usual manner, for example by a stop pin 19 fitted in an opening through the wall of the padlock body adjacent the longer shackle leg 17 in the mid region of the longer shackle leg, positioned so as to protrude slightly into an elongated slot in the shackle leg 17 and engage a stop shoulder near the bottom of the longer shackle leg 17 forming the lower boundry of the annular groove 17*b* to prevent complete withdrawal of the longer shackle leg from the padlock body. If the shackle is thus captured in the padlock body, the stop pin 19 is provided with a threaded shank threaded into the padlock body 11 in the mid region of the socket 14 to facilitate complete removal of the shackle 16, as for replacement or servicing, by insertion of a small screwdriver or the like into a slot in the end of the stop pin 19 to withdraw the pin from the shackle slot in the leg 17 so that it no longer protrudes into the shackle leg slot.

The free end portion of the shorter shackle leg 18 enters the closed bottom socket 15 in the padlock body, when the shackle is in the locking position, but the lower end of the shorter shackle leg 18 may be raised to an elevation slightly above the level of the top surface 12 of the padlock body when the shackle is withdrawn to the unlocking position, permitting the shackle to be swung about the axis of the longer leg 17 to an exposed position by rotating the shackle about the axis of the leg 17. The U-shaped shackle 16 also comprises the usual curved intermediate portion 20 extending between the legs 17 and 18, which serves as the portion which engages the usual apertured hasp members or pair of hasp members of locking hasps, such as those indicated at 21*a* and 21*b*, having apertures which are of a diameter closely approximating the diameter of the shackle 16 and adapted to register with each other to receive the shackle therethrough. The shackle legs 17 and 18 also have notches generally indicated at 22 and 23, of any of several optional patterns as hereinafter described, which are located within the padlock body 11 with the shackle 16 is in the lower locking position and which are disposed to receive confronting portions of a slidable locking bolt plate 24 as later described.

The padlock body 11 includes a closed bottom cavity or well 25 immediately adjacent the longer shackle leg socket 14, which is of generally cylindrical configuration having flats 25*a* along three sides thereof, in the illustrated embodiment, shaped and sized to snugly accommodate a key lock plug 26 of known construction, such as pin tumbler type or rotatable disc type key lock plugs, having a usual rotatable cylinder 26*a* therein and shaped to provide a bolt actuator 26*b* at the upper end of the rotatable cylinder or core 26*a* when the plug 26 is properly arranged in the padlock body. The shell or housing portion 26*c* of the key lock plug is also of generally cylindrical exterior configuration with three flats 26*d* conforming to and abutting against the flats 25*a* of the cavity 25 to hold the key lock plug 26 against rotation when it is seated in its cavity 25. The plug 26 also includes a key opening in its downwardly facing end portion of the rotatable cylinder core 26*a*, aligned vertically above a key opening 27 in the bottom surface 13 of the padlock body for insertion of the key upwardly into the key opening of the cylinder core 26*a*. In order to provide increased protection against drilling or tampering from the bottom wall of the padlock body into the key lock plug 26, a hardened annular protective disc 28 sized and shaped to snugly fit in the bottom of the well or cavity 25 is provided and is inserted into the well 25 before insertion of the plug 26 to protect the lower face of the rotatable cylinder portion 26*a* of the plug. The protective disc 28 is provided with a center opening 28*a* through which the key inserted into the key opening 27 may penetrate to pass into the key opening of the plug 26.

The plug 26, when inserted into the well 25 with its three flats 26*d* positioned in abutting confronting relation with the flats 25*a* of the well, is of such height relative to the well that its upper end having the bolt actuator 26*b* is spaced somewhat below the upper end of the well 25. This space accommodates an adapter 29, whose thickness corresponds to the distance between the top of the cavity 25 and the upper end of the plug 26 when seated in the cavity to fill the remainder of the space and translate movement from the bolt actuator 26*b* of the plug to the sliding locking member 24. As shown in the drawings, the adapter 29 has a substantially D-shaped center opening 29*a* therethrough, providing three flat walls and a fourth concave wall for the center opening to interfit in only the proper relation with the correspondingly shaped bolt actuator 26*b*. A channel recess 29*b* extending diametrically across the bottom face of the adapter disc 29 and having a width corresponding to the width of the center opening 29*a* intercepts the center opening is provided for the purpose of receiving the upwardly projecting bolt portion of the key lock cylinder, and an eccentric drive pin 29*c* projects upwardly from the upper face of the adapter disc body through a distance slightly greater than the thickness of the slidable locking bolt 24 to actuate the locking bolt and also control the slide cover member 30, to be later described in greater detail.

As will be observed, the padlock body 10 is provided with a shaped recess 31 opening through the end wall portion 11*b* of the padlock body and through the top 12 and has a depth from the plane of the top surface of the padlock body to accommodate both the thickness of the slide cover member 30 and of the locking bolt member 24. The lower portion 31*a* of the recess 31 is slightly narrower transversely than the upper portion 31*b* and penetrates somewhat nearer to the opposite end wall 11*c* of the padlock body than the upper portion 31*b*. The transversely narrower and longitudinally longer recess portion 31*a* accommodates the slidable locking bolt member 24, which in all six embodiments is in the shape of a rigid rectangular plate having 3 flat edges which may have either rounded or sharp corners and is shaped near or at the fourth edge to interfit with cavities or notches of various configurations in the longer shackle leg 17. In the embodiment illustrated in FIGS. 1–4, the locking bolt 24 has straight side surface 24*a* and 24*b* and a straight end surface 24*c*, and includes a transversely elongated slot 24*d* through most if its width to receive the drive pin 29*c* of the adapter disc 29. A shaped hole 24*e* is provided near the end 24*c* which is of circular cross section over most of its circumference having a diameter corresponding closely to the diameter of the unnotched portions of the shackle leg 17 and includes an extension slot portion 24*f* merging therewith and extending toward the straight end 24*c* of the locking bolt 24. The opposite end of the locking bolt member 24 is shaped to provide a concave recess 24*g* having a width corresponding to that of extension slot 24*f*, flanked by a pair of pointed leg portions 24*h* shaped to interfit into the notch 21 of the longer shackle leg 17 when the locking bolt is in the locking position so that the flanking leg portions 24*h* engage the shoulders of the notch 21 to prevent withdrawal of the shackle while the edge portions of the extension slot portion 24*f* interfit in the notch 22 of the short shackle leg 18 to prevent its withdrawl from locking position.

Covering the sliding bolt member 24 is the slide cover member 30 shaped over most of its length to conform to the horizontal cross sectional configuration of the upper recess portion 31*b* and having at least one groove 33 extending around the perimeter of the sides 30*a* and 30*b* and the curved end 30*c* of the slide member 30 to interfit with the tongue or rib formation 34 along the corresponding two sides and end of the recess portion 31*b* in the padlock body. It will be appreciated that while merely one tongue 34 and groove 33 are shown in the illustrated embodiment, the confronting edges of the slide member 30 and recess portion 31*b* may be provided with alternating vertically spaced sets of tongues and grooves to provide a greater number of tongue and groove sets than the number herein illustrated. The end 30*d* of the slide member 30 is flat and includes a depending wall portion 30*e* of a depth corresponding to the thickness of the locking bolt 24 to entirely close the entrance end of the recess 31 in the end wall portion 11*b* and extending outwardly covering relation to the flat end 24*c* of the locking bolt.

Figure 4:
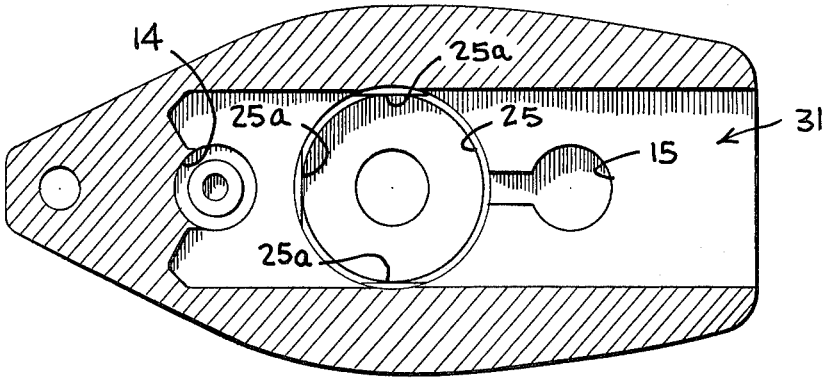
FIG. 4 is a horizontal section view taken along the line 4—4 of FIG. 3A.

In the form of the locking bolt member 24 and shackle 16 shown in FIGS. 1–4, the shackle is undercut along three sides, as illustrated in FIG. 4 to provide concave or channel-shaped notch portions 22*a*, 22*b* and 22*c* and 23*a* and 23*c* on the shackle legs 17 and 18 respectively facing to the opposite sides and toward the end 11*a*, 11*b* of the padlock body when the shackle is in the closed position aligned with the plane through the centers of the two shackle sockets 14,15. Various alternate forms of undercutting of the shackle legs to form the notches 22,23 are illustrated in FIGS. 5A–9A, showing sectioned fragmentary perspective views of different undercut configurations for use in association with various bolt member configurations shown in FIGS. 5–9. It will be appreciated, therefore, that with the shackle notches 22,23 in either of these configurations shown in FIGS. 5A–9A and the locking bolt member 24 in the configurations illustrated in FIGS. 5–9, the edges of the concave recesses or extensions 24*f* and 24*g* of the locking bolt member 24 will interfit into the notches along three sides of each of the shackle legs in the locked position of the locking bolt to securely hold the shackle in the retracted or locked position illustrated in FIG. 3.

Figure 5A:
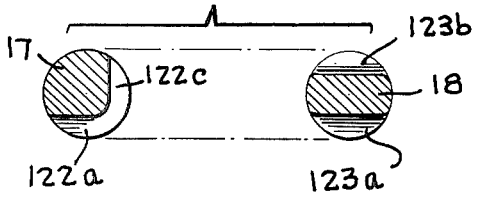
Figure 5:
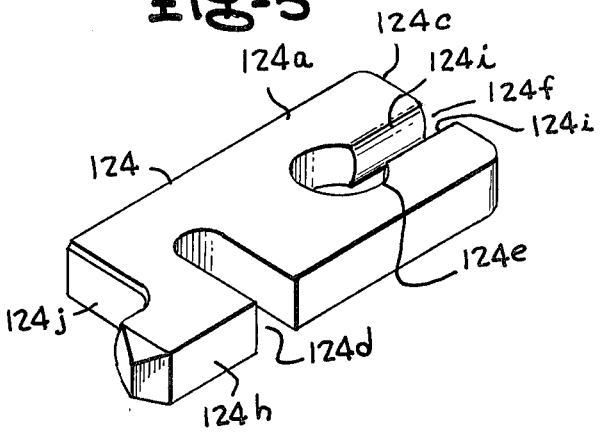
FIGS. 5—9 are fragmentary perspective views of slidable locking bolt members for use with the padlock, of modified shapes.

One alternate form of locking bolt is illustrated in FIG. 5, wherein the locking bolt member, here indicated by reference character 124, is of a configuration similar to the locking bolt member 24 of the previously described embodiment, but wherein the shorter shackle leg 18 is provided with notch portions 123*a* and 123*b* of concave configuration in the diametrically opposite side portions of the shackle leg to receive the convex edge portions 124*i* laterally bounding the slot 124*f* extending from the shackle leg receiving round hole 124*e* through the adjacent edge of the locking bolt member 124 to interfit in the oppositely facing notch portions 123*a* and 123*b*. The notch 121 in the longer shackle leg 17 of this embodiment is simply a concave recess facing to one side of the padlock body to receive the convex edge portion 124*h* of the locking bolt member projecting from the edge 124*j* located as to interfit in the notch 121 when the locking bolt is in locking position. The slot 124*d* in this embodiment for receiving the drive pin 29*c* of the adapter disc 29 opens through one side of the locking bolt member 124 in this embodiment. It will be appreciated that the convex edges of the slot 124*f* and of the extension 124*h* need not be convex as shown in this embodiment, but may be merely flat walls and the undercuts of the shackle legs forming the notches 121 and 122 may be rectangular cuts rather than concave cuts of similar configuration.

Figure 6A:
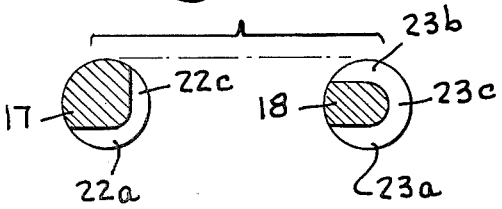
Figure 6:
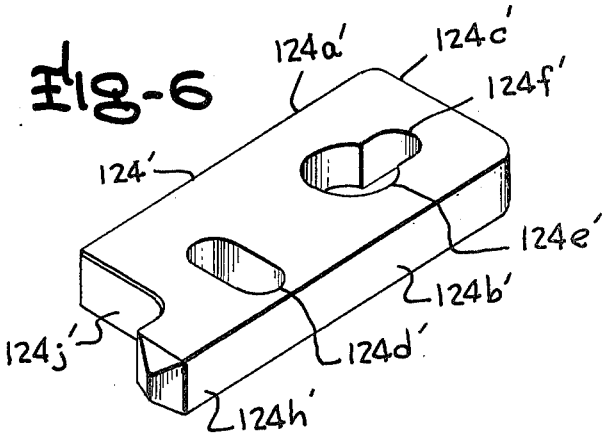

Another variation similar to the locking member of FIG. 5 is shown at 124' in FIG. 6, wherein the slidable locking bolt member 124' has the same exterior configuration as the bolt member 124 of FIG. 5 except that the slot 124*f* opening through the end wall 124*c* of FIG. 5 is replaced by a concave extension slot portion 124*f'* merging into the circular shackle leg receiving hole 124*e*, to provide an extension slot portion like the portion 24*f* of FIG. 4 which does not open through end wall 124*c'*. Of course, with this embodiment, the notch 23 of the shorter shackle leg 18 is undercut along three sides as at 23*a*, 23*b* and 23*c* in the FIG. 1 version. Also, the transverse slot 124*d'* in this version, like the slot 24 of the FIG. 1 version, does not open through the side wall 124*b'*.

Figure 7:
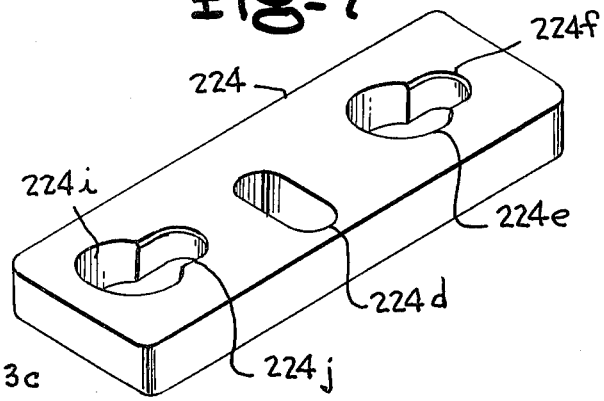
Figure 7A:
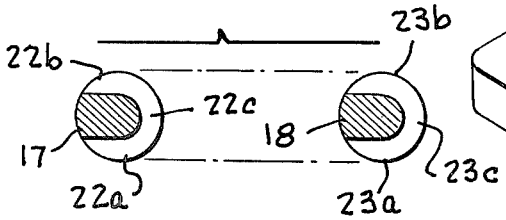
Figure 8:
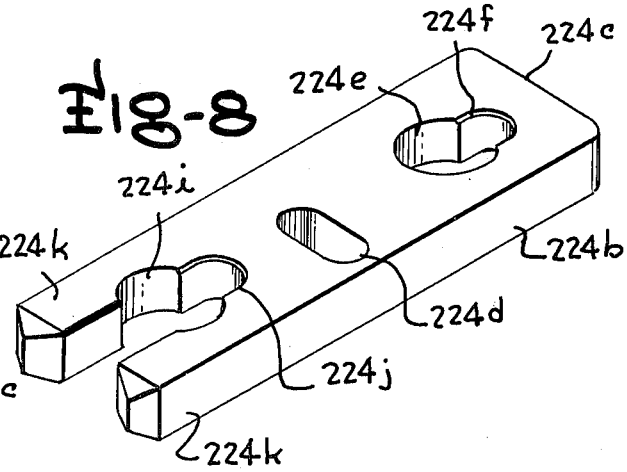
Figure 8A:
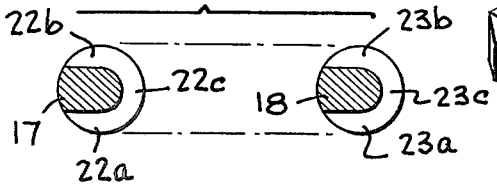

Yet another variation of the slidable locking bolt member is shown in FIG. 7, indicated by the reference character 224 having the circular hole 224*e* and associated narrower concave slot-like excursion 224*f* for coacting with the shackle leg 18 and its notch 22 and having the circular hole 224*i* and its slot-like excursion or extension 224*g* extending in a direction similar to the excursion 224*f*, to coact with the shackle leg 17 and its notch 21, and including an elongated slot-like excursion or extension 224*j* merging with the hole 224*i* and extending in the same direction as excursion 224*f*. A further modification shown in FIG. 8 is like the FIG. 7 form, but additionally includes a pair of pointed legs 224*k* projecting beyond the hole 224*i* in the direction opposite the excursion 224*j*. The form shown in FIGS. 7–8 operate in a manner similar to the form described in FIGS. 1–4, and all of the forms illustrated in FIGS. 1–6, and 8 permit removal of the bolt member 24, 124, or 224 when the long leg of the shackle is still in place, and the form of FIG. 8 includes the additional restraint that the shackle must be pulled to open position and rotated 180° to a predetermined angular position and returned downward or inwardly of the padlock body to dispose the longer shackle leg in its locked position but 180° out of phase to permit the bolt member to be removed after the slide member 30 has been removed. In the embodiment of FIG. 7, it will be noted that both ends of the locking bolt member are closed so that in these cases, total removal of the shackle from the padlock body is required before the locking bolt member can be withdrawn.

Figure 9:
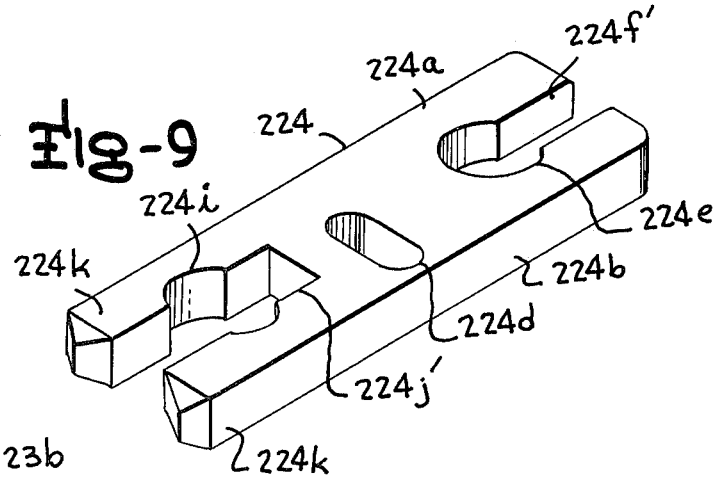
Figure 9A:
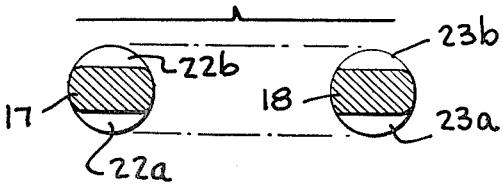

FIG. 9 illustrates another form similar to FIG. 8 except that the concave excursions 224*f* and 224*j* are replaced by rectangular slot formations having convex sides 224*f'* and 224*j'* to interfit into undercut notches 22*a*,22*b* and 23*a*,23*b* in two opposite sides of the two shackle legs 17,18.

It will also be noted that the slide member 30 is provided with an aperture in the form of a cylindrical hole 35 therethrough to receive the shorter shackle leg 18 in the locked position of the shackle, and the underside of the slide 30 is provided with a shaped recess 36 in one corner thereof designed to receive the drive pin 29*c* of the adapter disc 29 when the key lock plug cylinder is in the unlocked position and having a sufficient longitudinal extent to permit longitudinal movement of the slide member 30 from the withdrawn position to the closed position while accommodating the adapter disc drive pin 29*c* in the unlocked position. This recess 36 also includes an excursion 36*a* to permit arcuate movement of the adaper disc drive pin 29*c* from the unlocked to the locked position when the slide member 30 is in the fully closed position.

In order to assemble the parts of the padlock of either of the above described embodiments, and assuming the shackle 16, in the forms where the longer shackle leg 17 remains in the padlock body 11 in the unlocked position, the shackle 16 will be in unlocked condition with its shorter leg 18 swung to a laterally displaced position and the protective disc 28 is inserted and positioned at the bottom of the cavity or well 25 in the padlock body. The key lock plug 26 is then positioned in the cavity 25, locating the flats 26*d*, for example three of which are present in the illustrated embodiment, in registry with and against the flat 25*a* of the cavity 25, with the bottom or key entrance end of the plug 26 abutting the protective disc 28. The adapter disc 29 is then introduced into the space remaining in the upper portion of the cavity 25 above the key lock plug 26 and rotated to locate the center opening 29*a* therein to receive the upwardly projecting bolt actuator 26*a* of the key lock plug. The locking bolt member 24, or the modified versions thereof of FIGS. 5–9, is then introduced into the recess 31 and positioned to interfit the upwardly projecting drive pin member 29*c* of the adapter disc 29 into the slot 24*d* of the locking bolt member 24 (or into the corresponding slot portion of the sliding bolt members 124 or 224 as alternate embodiments) and the locking bolt member is positioned so that its lower face rests on and is slidable upon the upwardly facing bottom surface of the recess 31*a*. The slide cover member 30 is then interfitted into the upper padlock body recess portion 31*b* with the longitudinally extending tongue formations 34 at each side of the slide member interfitted in the side groove portions 33 of the slide cover member and the slide cover member is moved to the closed position shown in FIG. 3 with the shackle hole 30*a* therein registered with the socket 15 in the padlock body for receiving the shorter shackle leg 18. During this insertion movement of the slide cover member 30 into the recess 31, the slot 36 receives the upwardly projecting portion of the drive pin 29*c* when the key lock plug is in the unlocking position. The shackle can then be raised and swung to the closed position and returned inwardly toward the padlock body, or downwardly as viewed in FIG. 3, to position the lower portions of the shorter shackle leg 18 in the cover member hole 30*a* and the socket portion 15, whereupon the shackle leg 18 locks the slide cover member 30 in closed position covering the bolt member 24 and lock plug 26. Turning of the key lock plug 26 by the key to the locked position then projects the bolt member 24 (or 124 or 224) to the locked position, or toward the left as viewed in FIG. 3, interfitting the portions of the bolt member bounding the slots 24*f* and 24*g* (or the corresponding portion of the other versions) into the notches 22,23 of the shackle legs to place the padlock in locked condition. To remove the slide cover member 30 for subsequent changing of the plug 26, one must insert the proper key to unlock the plug cylinder and rotate the same to shift the drive pin 29*c* to bolt unlocking position in the bolt member slot 24*d* thus shifting the bolt member 24 (or its modified version) to unlocking position releasing it from interfitting relation in the shackle leg notches 22 and 23. Withdrawal of the shackle to unlocking position removes the shorter shackle leg 18 from the hole 30*c* in the cover member, permitting it to be removed when the key plug cylinder is returned to locking position locating the adapter drive pin 29*c* in the longitudinal portion 36*b* of the slide cover recess 36. The slide member 30 may be provided with spring biased detent balls 30*g* spring urged to protrude from the opposite sides 30,30*b* into detent sockets in the confronting sides of the recess 31 to restrain the slide cover member 30 in closed covering position against accidental dislodgement toward open position when the shackle is withdrawn from the slide cover member hole 30*a*.

What is claimed is:

1. A changeable plug exposed shackle padlock comprising a padlock casing having laterally spaced sockets opening through the upper portion thereof adjacent opposite ends of the casing for receiving legs of a shackle and accommodating axial reciprocative movement of the shackle between a lower locking position and an upper release position, a U-shaped shackle including a curved intermediate portion and longer and shorter shackle legs each having locking notches therein, said casing having a central substantially cylindrical plug cavity therein located between said sockets shaped to receive and removably house a key lock plug, a key lock plug removably received in said plug cavity having a lower end including a key passage adjacent a bottom wall portion of the casing for insertion of a key into said key lock plug through a key opening in said bottom wall portion, said casing having an elongated slideway cavity extending along an axis paralleling a center plane through the center axes of said sockets from the space overlying said central plug cavity through one end of the padlock casing outwardly adjacent the socket for the shorter leg, said slideway cavity having a lower slideway portion and having an upper slideway portion bounded laterally by alternating tongue and groove formations, a reciprocatively slidable cover member shaped to complement the upper slideway portion and extend in covering relation over the central plug cavity through the region of the shorter shackle leg and its socket to the adjacent end of the casing, said slidable cover member having alternating tongue and groove formations positioned to interfit with the tongue and groove formation laterally bounding said upper slideway portion and having a cylindrical opening therethrough registering with the socket for the shorter shackle leg when said slide member is fully seated in said slideway cavity in covering relation to said bore, and a slidable bolt plate member guided for longitudinal sliding movement between locking and release positions in said lower slideway portion having parallel sides in sliding abutment with opposite sides of the lower slideway portion and having locking shoulder portions engageable in said locking notches to lock the shackle in said lower locking portion, and bolt driving means for moving the bolt plate member between its locking and release positions upon key operation of the key lock plug.

2. A padlock as defined in claim 1, wherein said key lock plug includes a bolt operator projecting upwardly therefrom and the padlock includes an adapter disc in the top portion of said plug cavity coupled to said bolt operator for rotation about the center axis of the plug cavity and having an eccentric drive pin projecting into a transverse slot in the bolt plate member to drive the latter.

3. A padlock as defined in claim 2, including a hardened annular protective disc sized and shaped to snugly fit in the lower end of said plug cavity underlying the key lock plug to protect the latter against drilling.

4. A padlock as defined in claim 1, wherein said padlock casing has a flat top wall surface through which said upwardly opening sockets extend, said shackle projecting from said top wall surface and having one leg thereof slidably retained in said casing by removable means, and said slidable cover member having a flat top surface located flush with said top wall surface and forming portion of said top wall surface through which the socket for the shorter shackle leg opens.

5. A padlock as defined in claim 2, wherein said padlock casing has a flat top wall surface through which said upwardly opening sockets extend, said shackle projecting from said top wall surface and having one leg thereof slidably retained in said casing by removable means, and said slidable cover member having a flat top surface located flush with said top wall surface and forming the portion of said top wall surface through which the socket for the shorter shackle leg opens.

6. A padlock as defined in claim 3, wherein said padlock casing has a flat top wall surface through which said upwardly opening sockets extend, said shackle projecting from said top wall surface and having one leg thereof slidably retained in said casing by removable means, and said slidable cover member having a flat top surface located flush with said top wall surface and forming the portion of said top wall surface through which the socket for the shorter shackle leg opens.

7. A padlock as defined in claim 1, wherein said bolt plate member is movable responsive to key operation of the key lock plug to said unlocking and release positions and the bolt driving means having a drive pin projecting upwardly therefrom eccentric to the axis of rotation of the key lock plug, said slidable cover member having a downwardly facing interlock slot therein receiving said drive pin shaped to prevent movement of the cover member from its fully seated position when the key lock plug occupies a first predetermined position and said slot having an extension leg portion opening through an end of the cover member accommodating relative movement of said cover member and pin when the plug occupies a second predetermined position to permit withdrawal of the cover member from said slideway when the shackle is in upper release position and the key lock plug is in said second predetermined position.

8. A padlock as defined in claim 2, wherein said bolt plate member is movable responsive to key operation of the key lock plug to said unlocking and release positions and the bolt driving means having a drive pin projecting upwardly therefrom eccentric to the axis of rotation of the key lock plug, said slidable cover member having a downwardly facing interlock slot therein receiving said drive pin shaped to prevent movement of the cover member from its fully seated position when the key lock plug occupies a first predetermined position and said slot having an extension leg portion opening through an end of the cover member accommodating relative movement of said cover member and pin when the plug occupies a second predetermined position to permit withdrawal of the cover member from said slideway when the shackle is in upper release position and the key lock plug is in said second predetermined position.

9. A padlock as defined in claim 3, wherein said bolt plate member is movable responsive to key operation of the key lock plug to said unlocking and release positions and the bolt driving means having a drive pin projecting upwardly therefrom eccentric to the axis of rotation of the key lock plug, said slidable cover member having a downwardly facing interlock slot therein receiving said drive pin shaped to prevent movement of the cover member from its fully seated position when the key lock plug occupies a first predetermined position and said slot having an extension leg portion opening through an end of the cover member accommodating relative movement of said cover member and pin when the plug occupies a second predetermined position to permit withdrawal of the cover member from said slideway when the shackle is in upper release position and the key lock plug is in said second predetermined position.

10. A padlock as defined in claim 4, wherein said bolt plate member is movable responsive to key operation of the key lock plug to said unlocking and release positions and the bolt driving means having a drive pin projecting upwardly therefrom eccentric to the axis of rotation of the key lock plug, said slidable cover member having a downwardly facing interlock slot therein receiving said drive pin shaped to prevent movement of the cover member from its fully seated position when the key lock plug occupies a first predetermined position and said slot having an extension leg portion opening through an end of the cover member accommodating relative movement of said cover member and pin when the plug occupies a second predetermined position to permit withdrawal of the cover member from said slideway when the shackle is in upper release position and the key lock plug is in said second predetermined position.

11. A changeable plug padlock as defined in claim 1, wherein the locking notches in at least one of the shackle legs are undercut channel recesses in two diametrically opposite side portions of the shackle leg defining a pair of spaced horizontally alined oppositely facing laterally opening channels lying along rectilinear paths paralleling and symmetrically spaced from said center plane, and said bolt plate member having a constricted extension slot formation communicating with shackle leg receiving holes in the bolt plate member flanked by a pair of confronting shoulder formations complementing said channels and located in symmetrical flanking relation to said center plane to interfit into the channel recesses of the shackle leg upon longitudinal movement of the bolt plate member parallel to said center plane toward locking position and secure the shackle against withdrawl from its lower locking position.

12. A changeable plug padlock as defined in claim 2, wherein the locking notches in at least one of the shackle legs are undercut channel recesses in two diametrically opposite side portions of the shackle leg defining a pair of spaced horizontally alined oppositely facing laterally opening channels lying along rectilinear paths paralleling and symmetrically spaced from said center plane, and said bolt plate member having a constricted extension slot formation communicating with shackle leg receiving holes in the bolt plate member flanked by a pair of confronting shoulder formations complementing said channels and located in symmetrical flanking relation to said center plane to interfit into the channel recesses of the shackle leg upon longitudinal movement of the bolt plate member parallel to said center plane toward locking position and secure and shackle against withdrawl from its lower locking position.

13. A changeable plug padlock as defined in claim 5, wherein the locking notches in at least one of the shackle legs are undercut channel recesses in two diametrically opposite side portions of the shackle leg defining a pair of spaced horizontally alined oppositely facing laterally opening channels lying along rectilinear paths paralleling and symmetrically spaced from said center plane, and said bolt plate member having a constricted extension slot formation communicating with shackle leg receiving holes in the bolt plate member flanked by a pair of confronting shoulder formations complementing said channels and located in symmetrical flanking relation to said center plane to interfit into the channel recesses of the shackle leg upon longitudinal movement of the bolt plate member parallel to said center plane toward locking position and secure the shackle against withdrawl from its lower locking position.

14. A changeable plug padlock as defined in claim 1, wherein the locking notches in the two shackle legs are undercut channel recesses in two diametrically opposite side portions of each shackle leg defining spaced apart horizontally alined oppositely facing laterally opening channel-shaped grooves lying along rectilinear paths paralleling and symmetrically spaced from said center plane, and said bolt plate member having a pair of passages therethrough sized to receive unnotched portions of the shackle legs therethrough and constricted extension slots extending therefrom toward the end of the casing nearest the shorter leg and defining pairs of confronting shoulder formations complementing said channel grooves and located in symmetrical flanking relation to said center plane to interfit into the channel grooves and receive the shackle against withdrawl from its locking position in the locking position of the bolt plate member.

15. A changeable plug padlock as defined in claim 2, wherein the locking notches in the two shackle legs are undercut channel recesses in two diametrically opposite side portions of each shackle leg defining spaced apart horizontally alined oppositely facing laterally opening channel-shaped grooves lying along rectilinear paths paralleling and symmetrically spaced from said center plane, and said bolt plate member having a pair of passages therethrough sized to receive unnotched portions of the shackle legs therethrough and constricted extension slots extending therefrom toward the end of the casing nearest the shorter leg and defining pairs of confronting shoulder formations complementing said channel grooves and located in symmetrical flanking relation to said center plane to interfit into the channel grooves and receive the shackle against withdrawl from its locking position in the locking position of the bolt plate member, the plate member also having another like extension slot extending from the passage for the longer shackle leg through the adjacent end of the bolt plate member to accommodate movement of the latter relative to the longer leg when the shackle is displayed 180° from its locking position for removal of the bolt plate member from the slideway cavity.

16. A changeable plug padlock as defined in claim 2, wherein the locking notches in the shackle legs are undercut channel recesses circumscribing three sides of each shackle leg defining substantially U-shaped channels opening toward opposite sides and toward a corresponding end of the padlock casing, and said bolt plate member having a pair of circular holes therethrough for receiving unnotched portions of the shackle legs therethrough and having constricted extension slots communicating with said holes flanked by U-shaped shoulder formations complementing the U-shaped channel recesses in each shackle leg and located to interfit into the channel recesses upon longitudinal movement of the bolt plate member parallel to said center plane toward locking position to secure the shackle against withdrawal from its locking position.

17. A changeable plug padlock as defined in claim 3, wherein the locking notches in the shackle legs are undercut channel recesses circumscribing three sides of each shackle leg defining substantially U-shaped channels opening toward opposite sides and toward a corresponding end of the padlock casing, and said bolt plate member having a pair of circular holes therethrough for receiving unnotched portions of the shackle legs therethrough and having constricted extension slots communicating with said holes flanked by U-shaped shoulder formations complementing the U-shaped channel recesses in each shackle leg and located to interfit into the channel recesses upon longitudinal movement of the bolt plate member parallel to said center plane toward locking position to secure the shackle against withdrawal from its locking position.

18. A changeable plug padlock as defined in claim 5, wherein the locking notches in the shackle legs are undercut channel recesses circumscribing three sides of each shackle leg defining substantially U-shaped channels opening toward opposite sides and toward a corresponding end of the padlock casing, and said bolt plate member having a pair of circular holes therethrough for receiving unnotched portions of the shackle legs therethrough and having constricted extension slots communicating with said holes flanked by U-shaped shoulder formations complementing the U-shaped channel recesses in each shackle leg and located to interfit into the channel recess upon longitudinal movement of the bolt plate member parallel to said center plane toward locking position to secure the shackle against withdrawal from its locking position.

* * * * *